US010418720B1

(12) United States Patent
Tarng et al.

(10) Patent No.: US 10,418,720 B1
(45) Date of Patent: Sep. 17, 2019

(54) SIGNAL LINE CONVERSION STRUCTURE OF ANTENNA ARRAY

(71) Applicant: National Chiao Tung University, Hsinchu (TW)

(72) Inventors: Jenn-Hwan Tarng, Hsinchu (TW); Chi-Yang Chang, Taipei (TW); Che-Hao Chang, New Taipei (TW); Jing-Cheng Hong, Chiayi (TW)

(73) Assignee: National Chiao Tung University, Hasinchu (TW)

( * ) Notice: Subject to any disclaimer, the term of this patent is extended or adjusted under 35 U.S.C. 154(b) by 0 days.

(21) Appl. No.: 16/017,228

(22) Filed: Jun. 25, 2018

(30) Foreign Application Priority Data

Mar. 22, 2018 (TW) ..... 107109869 A

(51) Int. Cl.

| | |
|---|---|
| ***H01Q 1/48*** | (2006.01) |
| ***H01Q 21/00*** | (2006.01) |
| ***H01Q 1/24*** | (2006.01) |
| ***H01Q 21/30*** | (2006.01) |

(52) U.S. Cl.
CPC ..... *H01Q 21/0075* (2013.01); *H01Q 1/243* (2013.01); *H01Q 1/48* (2013.01); *H01Q 21/30* (2013.01)

(58) Field of Classification Search
CPC ..... H01Q 21/00; H01Q 1/24; H01Q 1/48; H01Q 21/30
USPC ..... 343/848
See application file for complete search history.

(56) References Cited

U.S. PATENT DOCUMENTS

2009/0267201 A1* 10/2009 Chang ..... H01L 23/66 257/664
2016/0365684 A1* 12/2016 Li ..... H01R 24/44

FOREIGN PATENT DOCUMENTS

| | | | |
|---|---|---|---|
| CN | 101569059 | A | 10/2009 |
| CN | 103597661 | A | 2/2014 |
| TW | 200945656 | A | 11/2009 |

(Continued)

OTHER PUBLICATIONS

A. N. Sychev, et al, "A Novel Trans-Directional Coupler Based on Vertically Installed Planar Circuit," 2015 European Microwave Conference (EuMA), Paris, 2015, pp. 283-286.

(Continued)

*Primary Examiner* — Andrea Lindgren Baltzell
(74) *Attorney, Agent, or Firm* — Muncy, Geissler, Olds & Lowe, P.C.

(57) ABSTRACT

A signal line conversion structure of the antenna array is disposed between the antenna array and the circuit substrate, which includes a first dielectric substrate is disposed on the circuit substrate, a second dielectric substrate is vertically disposed on the first dielectric substrate and divided into a first region and a second region, and the second dielectric substrate is provided with the antenna array. At least one signal line is disposed on the first region and extends to the second dielectric substrate for connecting the circuit substrate and the antenna array. A metal connecting plate has at least three metal through holes pierced in the first dielectric substrate and connected to the second ground layer. The metal connecting plate is connected to the first ground layer of the first dielectric substrate and the second ground layer of the second dielectric substrate through the metal through holes.

10 Claims, 5 Drawing Sheets

(56) References Cited

FOREIGN PATENT DOCUMENTS

TW 201644092 A 12/2016

OTHER PUBLICATIONS

W. Lu, et al, "A Broadband Quarter-Wavelength Impedance Transformer Using Vertically Installed Planar Coupler,"2011 IEEE MTT-S International Microwave Symposium, Baltimore, MD, 2011, pp. 1-4.
S. Y. Zheng, et al, "Broadband Coupler Using Improved Vertically Installed Planar Structure," Proceedings of the Fourth European Conference on Anennas and Propagation, Barcelona, Spain, 2010, pp. 1-4.
W. Liu, et al, "A Wideband Tunable Reflection-Type Phase Shifter with Wide Relative Phase Shift," in IEEE Transactions on Circuits and Systems II: Express Briefs, vol. 64, Issue: 12, Dec. 2017, pp. 1-5.
T. Jaschke, et al, "Rx/Tx Integration Concepts for Ground Segment SatCom Antenna Arrays," 2016 German Microwave Conference (GeMiC), Bochum, 2016, pp. 27-30.
E. Miralles, et al, "Low Cost Multipurpose RF System Approach: Integration of a MIMO Radar and a Communications Frontend on a Single PCB," 2016 European Radar Conference (EuRAD), London, 2016, pp. 137-140.
U. Nandi, et al, "Novel Millimeter Wave Transition From Microstrip Line to Groove Gap Waveguide for MMIC Packaging and Antenna Integration," in IEEE Microwave and Wireless Components Letters , vol. 27, Issue: 8, Aug. 2017, pp. 1-3.

* cited by examiner

SIGNAL LINE CONVERSION STRUCTURE OF ANTENNA ARRAY

This application claims priority for Taiwan patent application no. 107109869 filed on Mar. 22, 2018, the content of which is incorporated by reference in its entirety.

BACKGROUND OF THE INVENTION

Field of the Invention

The present invention relates to a signal line conversion structure, particularly to a signal line conversion structure featuring vertical signal conversion and applying to antenna arrays.

Description of the Prior Art

With population of intelligent mobile devices, such as smart phones, wireless communication develops fast. Most of the smart phones of users adopt at least the third generation wireless communication technology, such the 3G, or 4G wireless communication technology. However, the newest generation of wireless communication technology—the 5G technology—has become the focal technology discussed and developed by academics and industry and supported by governments. Each generation of wireless communication technology was evolved with advancement in data transmission rate, data capacity and system performance.

After established in 2009, the Wireless Gigabit Alliance (WiGig) has been devoted to pushing the free 60 GHz frequency band for realizing the multi-Gigabit wireless transmission technology. The multi-Gigabit wireless transmission technology is a very fast short-distance wireless communication technology, able to transmit large documents in families. In order to upgrade the transmission capacity in various device environments, a directional high-speed wireless communication technology, which is distinct from the conventional wireless communication technology, was also pushed later.

Compared with the conventional wireless communication systems, the millimeter-wave wireless communication system pushed by WiGig and using the 60 GHz frequency band has a higher bandwidth, which is sufficient to establish a high-rate wireless transmission network. The transmission rate of the high-rate wireless transmission network is 10 times faster than that of the existing Wi-Fi wireless network. However, high frequency of the millimeter-wave wireless communication system also results in higher loss in electromagnetic wave transmission.

In order to solve the abovementioned problems, the millimeter-wave wireless communication system needs a high-gain antenna and a power amplifier (PA). Besides, it also needs a low-loss integration structure of the millimeter-wave wireless communication modules. In addition to the high-gain antenna satisfying the requirement of the smart beam-forming mechanism, many conventional technologies adopt the antenna array to solve the aforementioned problem. However, it demands a very high flexibility in the integration layout of the transceiver module and the antenna array. For example, the number of the 4×4 or 8×8 antenna array and the loss thereof brings about a big challenge in feeding network design and system integration.

Accordingly, the present invention provides a signal line conversion structure applying to a feeding network antenna system for increasing the gain of the antenna array thereon.

SUMMARY OF THE INVENTION

The primary objective of the present invention is to provide a signal line conversion structure of an antenna array, which integrates a horizontal dielectric substrate and a vertical dielectric substrate to increase the antenna gain of the antenna array in the vertical direction. With the increase of antenna gain, the power amplifier in the horizontal direction decreases in its efficiency and generates much heat. In the present invention, the antenna array is not disposed on the horizontal dielectric substrate but disposed on the vertical dielectric substrate. Thus, less space of the horizontal dielectric is occupied, and more space is available for dissipating the heat generated in the horizontal dielectric substrate.

Another objective of the present invention is to provide a signal line conversion structure of an antenna array, which integrates microstrip lines to increase the heat radiation effect and antenna gain, and which uses the signal lines of the microstrip lines and the metal through holes of the metal connecting plate to effectively transfer the signals from the horizontal plane to the antenna array on the vertical plane, whereby to effectively increase the bandwidth of the conversion structure. Further, the connection of the metal through holes and the ground layers can effectively decrease energy loss in signal transmission.

In order to achieve the aforementioned objectives, the present invention proposes a signal line conversion structure of an antenna array, which comprises a first dielectric substrate, a second dielectric substrate, at least one signal line, and a metal connecting plate. The first dielectric substrate is disposed on a circuit substrate. The back side of the first dielectric substrate has a first ground layer. The second dielectric substrate is vertically installed in the first dielectric substrate and divides the first dielectric substrate into a first region and a second region. A second ground layer is formed on one side of the second dielectric substrate, which faces the second region. An antenna array is also disposed on the second dielectric substrate. The signal lines are disposed on the first region of the first dielectric substrate and extended to the second dielectric substrate for connecting the circuit substrate with the antenna array. The metal connecting plate has at least three metal through holes, and the number of the metal through holes is an odd number. The metal connecting plate is disposed on the second region of the first dielectric substrate and connected with the second ground layer. The metal through holes are formed in the first dielectric substrate. Through the metal through holes, the metal connecting plate is connected with the first ground layer of the first dielectric substrate and the second ground layer of the second dielectric substrate.

In the present invention, the second dielectric substrate is a soft substrate or a flexible substrate; the position of the antenna array can be changed.

In the present invention, the circuit substrate is a circuit substrate of a power amplifier array.

In the present invention, the antenna array is a high-power antenna array, which is a high-frequency antenna of the fifth generation wireless communication technology or the succeeding generation wireless communication technology.

In the present invention, the first dielectric substrate is a high-frequency circuit board.

In the present invention, the second dielectric substrate is a high-frequency microwave radio-frequency circuit board.

In the present invention, the diameter of the metal through holes is 0.2 mm.

In the present invention, the signal lines are microstrip lines.

In the present invention, the terminal of the signal line, which is extended to the second dielectric substrate, is aligned to the middle one of at least three metal through holes.

Below, embodiments are described in detail in cooperation with the attached drawings to make easily understood the objectives, technical contents, characteristics and accomplishments of the present invention.

DETAILED DESCRIPTION OF THE INVENTION

With development of high-frequency antennas, the present invention proposes a signal line conversion structure of an antenna array, especially the antenna array operating at 57-66 GHz. The present invention applies to a conversion structure between the circuit substrate on the horizontal surface and the antenna array on the vertical surface in the V-band feeding network. In one embodiment, the signal line conversion structure of an antenna array of the present invention is disposed between the power amplifier array substrate and the high-power antenna array. The signal lines (such as microstrip lines) convert the signals in the horizontal surface and then transfer the signals upwards to the antenna array on the above. The spatial configuration in the vertical surface allows the number of the antenna array to be variable and increases the flexibility of the layout of the antenna arrays.

Figure 1:
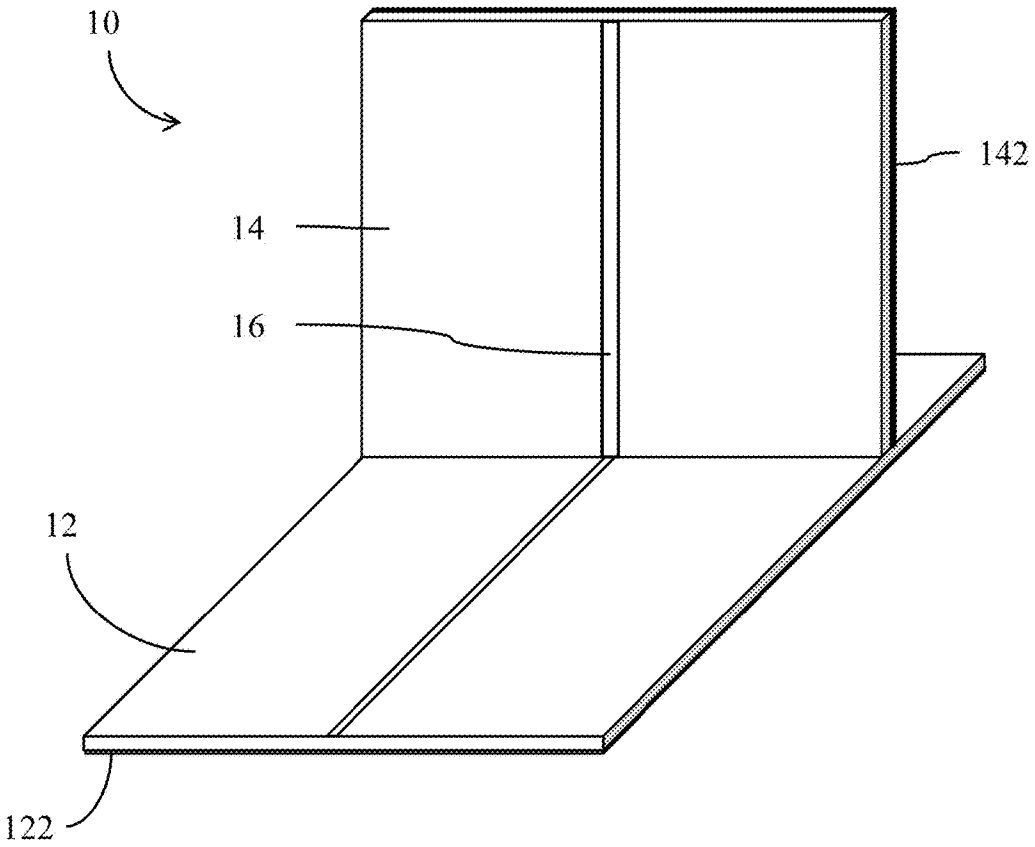
FIG. 1 is a perspective view schematically showing a signal line conversion structure of an antenna array according to a first embodiment of the present invention.
Figure 2:
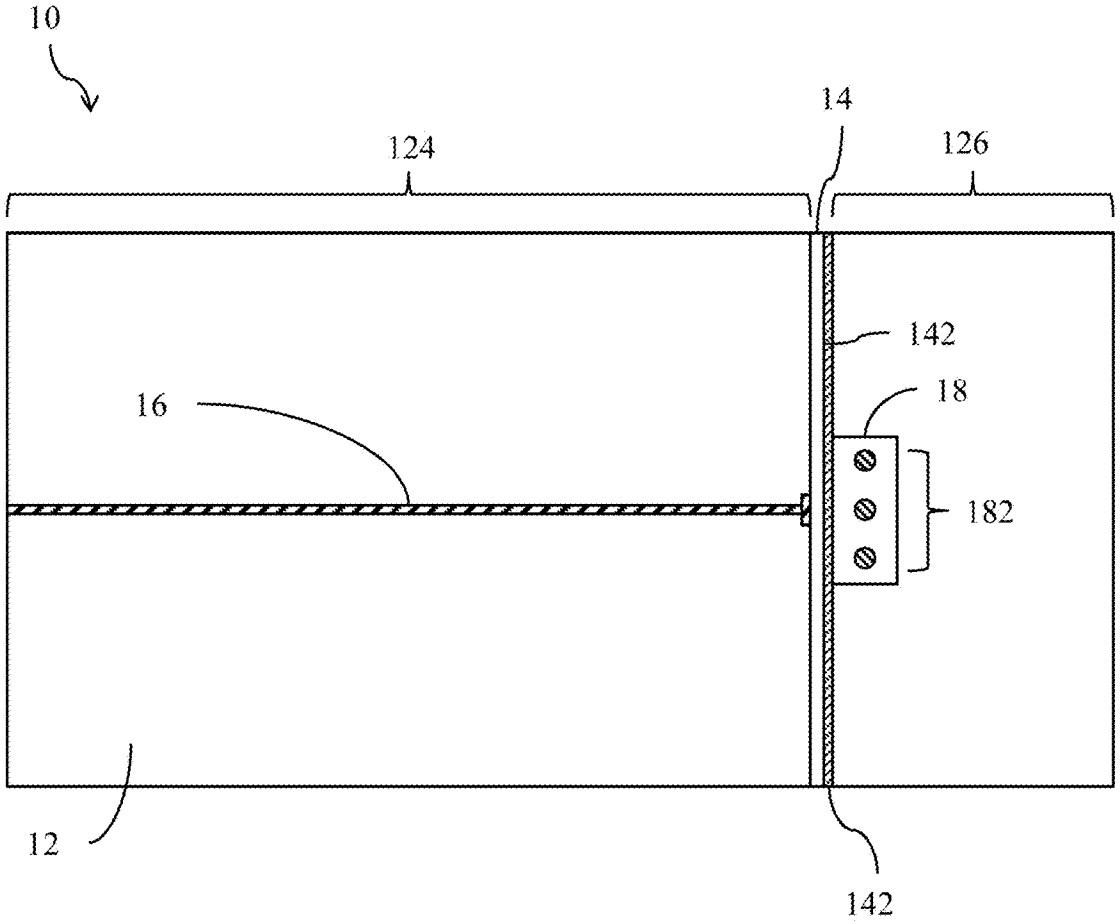
FIG. 2 is a top view schematically showing a signal line conversion structure of an antenna array according to the first embodiment of the present invention.
Figure 3:
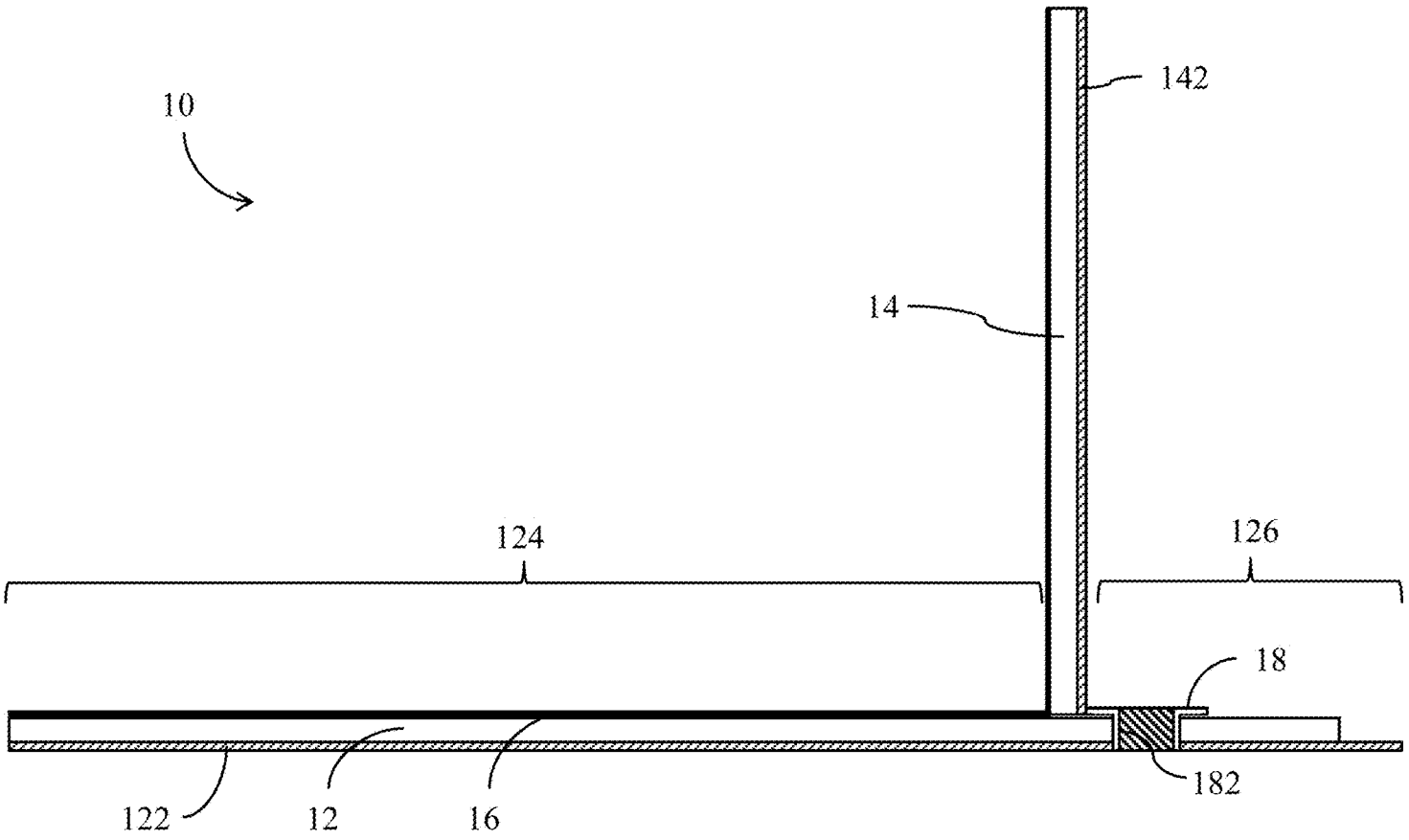
FIG. 3 is a side view schematically showing a signal line conversion structure of an antenna array according to the first embodiment of the present invention.

Refer to FIGS. 1-3. The present invention proposes a signal line conversion structure 10 of an antenna array, which comprises a first dielectric substrate 12, a second dielectric substrate 14, at least one signal line 16, and a metal connecting plate18. The metal connecting plate 18 has at least three metal through holes 182, and the number of the metal through holes 182 is an odd number. For example, the number of the metal through holes 182 is 3, 5, 7, or another odd number. In the embodiment shown in FIGS. 1-3, three metal through holes 182 and one signal line 16 are used as the exemplification. The signal line 16 is a microstrip line. The first dielectric substrate 12 is a high-frequency circuit board, such as the RO4350B high-frequency circuit board. The second dielectric substrate 14 is a high-frequency microwave radio-frequency circuit board, such as the RT5880 high-frequency microwave radio-frequency board. However, the aforementioned embodiment is only to exemplify the present invention. The present invention doses not limit that the substrate must be the substrate of the above-mentioned specifications. The user may adopt suitable substrates according to requirement.

The first dielectric substrate 12 is disposed on a substrate, such as the circuit substrate (not shown in the drawings) of the power amplifier array. The back side of the first dielectric substrate 12 has a first ground layer 122. The second dielectric substrate 14 is vertically installed on the front side of the first dielectric substrate 12. In one embodiment, the second dielectric substrate 14 is firmly joined to the first dielectric substrate 12 in a welding method. After joint, the second dielectric substrate 14 divides the front side of the first dielectric substrate 12 into a first region 124 and a second region 126. The surface of the second dielectric substrate 14, which faces the second region 126, has a second ground layer 142. The antenna array may be installed in one end of the second dielectric substrate 14, which is not connected with the first dielectric substrate 12. The present invention neither limits the circuit structure and the electric connectivity of the circuit substrate below the first dielectric substrate 12 nor limits the arrangement of the antenna array on the second dielectric substrate 14. The aforementioned antenna array may be a high-power antenna array, such as an antenna array of the high-frequency antennas of the 5th generation or more advanced wireless communication technology. The present invention is focused on the connection structure of the first dielectric substrate 12 and the second dielectric substrate 14, which are located between the antenna array and the circuit substrate.

The signal line 16 is disposed on the first regions 124 of the first dielectric substrate 12 and extended to the surface of the second dielectric substrate 14, which faces the first region 124. The signal line 16 may be connected with the circuit substrate and the antenna array. The present invention does not limit the way how to fabricate the signal line 16 on the first dielectric substrate 12 and the second dielectric substrate 14. In one embodiment, the signal line 16 is fabricated in a photo-etching method. However, the present invention is not limited by the embodiment.

The metal connecting plate 18 is disposed on the second region 126 of the first dielectric substrate 12 and connected with the second ground layer 142. Metal through holes 182 of the metal connecting plate 18 penetrate the first dielectric substrate 12. The central one of the three metal through holes 182 is aligned with one terminal of the signal line 16, which is extended to the second dielectric substrate 14. The metal connecting plate 18 is connected with the first ground layer 122 of the first dielectric layer 12 and the second ground layer 14 of the second dielectric substrate 14 through the three metal through holes 182.

The present invention uses the aforementioned signal line conversion structure of an antenna array as the connection structure of the horizontal circuit substrate and the vertical antenna array. In one embodiment, the present invention uses the signal lines microstrip lines as the signals lines to shunt the signals of the circuit substrate from the horizontal direction to the vertical direction and transfers the signals upwards to the antenna array. The present invention also uses the metal through holes of the metal connecting plate to connect the ground layers of the two dielectric substrates to minimize the signal transmission loss, which results from discontinuous structure, and improve the operating bandwidth.

The present invention does not limit that the horizontal substrate and the vertical substrate must use the same material or have the same thickness. The materials and thicknesses thereof may be determined according to requirement. The present invention is mainly characterized in using the microstrip lines, the metal connecting plate and the metal through holes to effectively integrate the dielectric substrates in different directions. The present invention does not limit the number of the signal line conversion structures disposed between the circuit substrate and the antenna array. In the present invention, several signal line conversion structures of antenna arrays may be distributed on the circuit substrate. In the present invention, it is unnecessary to dispose all the antenna arrays on the horizontal dielectric substrate. Thus, the present invention increase much heat radiation space for the antenna arrays. While applied to high-power and high-frequency antenna arrays, the present invention can effectively increase the heat-radiation area and dissipate the heat generated in the circuit substrate.

In one embodiment, the vertical second dielectric substrate is a soft or flexible substrate. Thus, the second dielectric substrate is not necessarily in a vertical state but can be appropriately bent to change the orientation of the antenna array flexibly. The user can flexibly adjust the antenna array to achieve the optimized performance of the antenna system.

Figure 4:
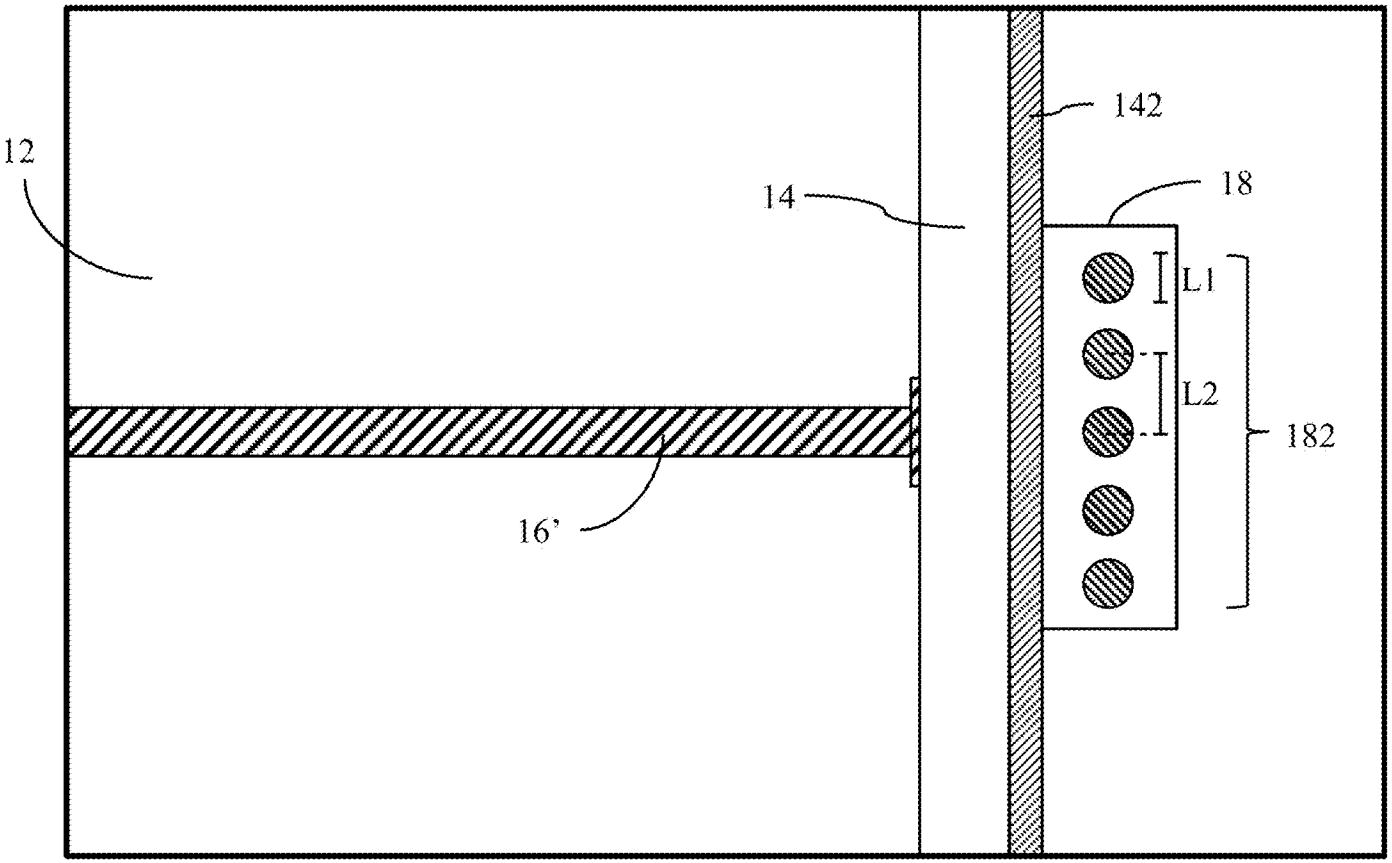
FIG. 4 is a top view schematically showing a signal line conversion structure of an antenna array according to a second embodiment of the present invention.

The present invention does not limit number of the metal through holes. The number of the metal through holes may be more than 3 and must be an odd number. The present invention does not limit the width of the signal line. Refer to FIG. 4. In this embodiment, the present invention has 5 metal through holes 182. In one embodiment, the diameter L1 of the metal through holes 182 is 0.2 mm preferably. In one embodiment, the distance L2 between the centers of two adjacent metal through holes 182 is 0.4 mm. In one embodiment, the signal line 16' has a width of 0.2 mm in the first dielectric substrate 12. While the signal line 16' is extended to the second dielectric substrate 14, the signal line 16' has a width of 0.46 mm. However, the present invention is not limited by the values mentioned in the above embodiments.

Figure 5:
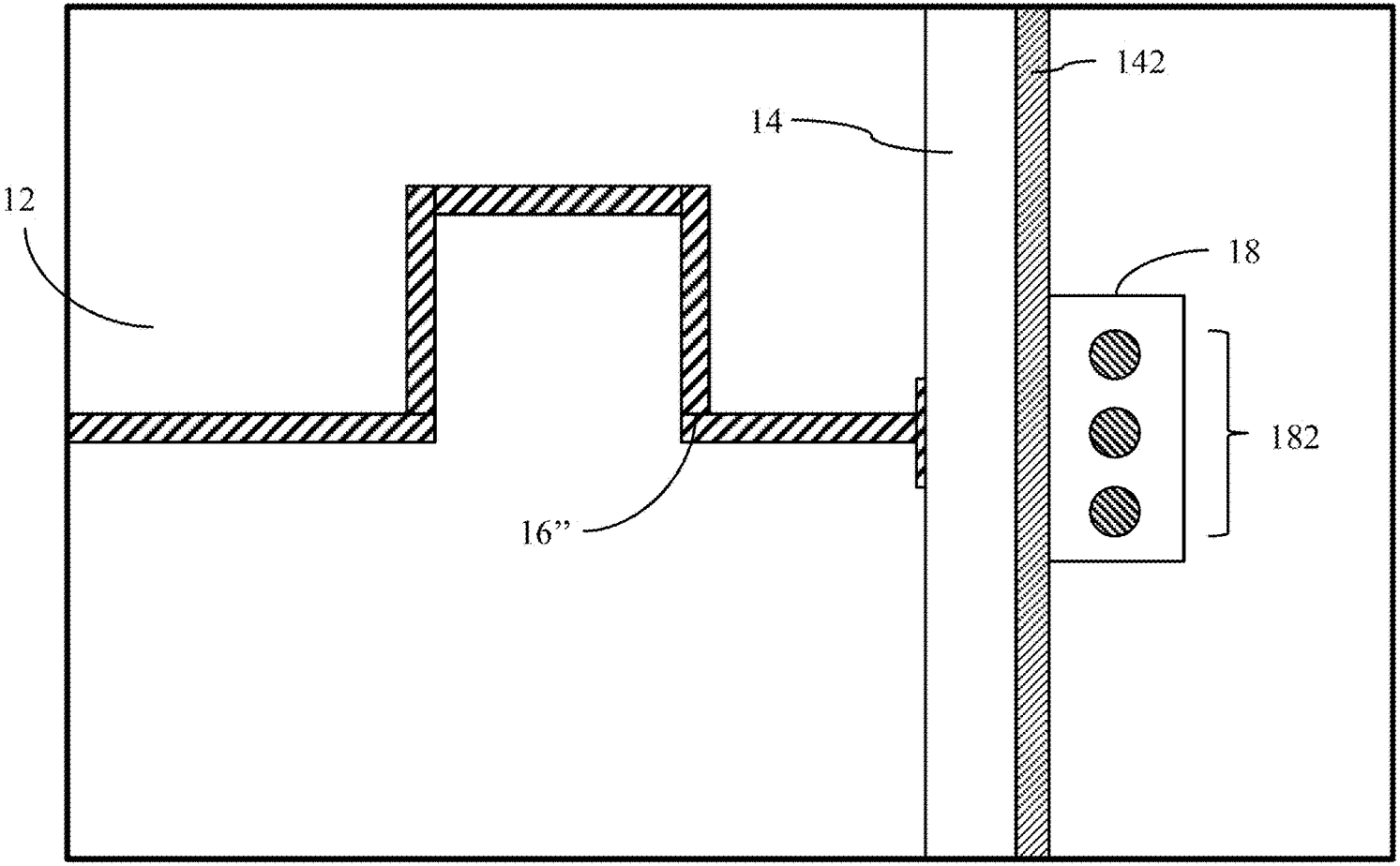
FIG. 5 is a top view schematically showing a signal line conversion structure of an antenna array according to a third embodiment of the present invention.

The present invention does not limit the pattern of the signal line. The signal line is exemplified by a straight line in the aforementioned embodiments. Refer to FIG. 5. In this embodiment, the signal line 16" is a curved line on the first dielectric substrate 12, having a crooked shape. The user may design the pattern of the signal line according to requirement.

Among the aforementioned embodiments, the first embodiment, which has the straight signal line on the first and second dielectric substrates and has three metal through holes, has better frequency response and higher output power. Therefore, more metal through holes do not necessarily imply higher performance in the present invention. The optimized number of the metal through holes is 3. In such a case, the metal wall effect generated by the metal connecting plate can convert the signal from the horizontal direction to the vertical direction, whereby to effectively minimize the energy loss. The vertical conversion structure of the present invention increases the heat radiation space, enhances the heat dissipation effect, and provides the layout flexibility of the antenna arrays. Therefore, the present invention has very high competitive advantage in the field of high-frequency and high-power antenna systems.

The embodiments described above are only to demonstrate the technical thought and characteristics of the present invention to enable the persons skilled in the art to understand, make, and use the present invention. However, these embodiments are not intended to limit the scope of the present invention. Any equivalent modification or variation according to the spirit of the present invention is to be also included by the scope of the present invention.

What is claimed is:

1. A signal line conversion structure of an antenna array, disposed between an antenna array and a circuit substrate, and comprising a first dielectric substrate disposed on said circuit substrate, wherein a back side of said first dielectric substrate has a first ground layer;

a second dielectric substrate vertically installed in a front surface of said first dielectric substrate and dividing said first dielectric substrate into a first region and a second region, wherein one surface of said second dielectric substrate, which faces said second region, has a second ground layer, and wherein said antenna array is disposed on one end of said second dielectric substrate, which is not connected with said first dielectric substrate;

at least one signal line disposed on said first region of said first dielectric substrate and extended to one surface of said second dielectric substrate, which faces said first region, to connect said circuit substrate with said antenna array; and a metal connecting plate having at least three metal through holes, disposed on said second region of said first dielectric substrate, and connected with said second ground layer, wherein a number of said at least three metal through holes is an odd number, and wherein said at least three metal through holes penetrate said first dielectric substrate, and wherein said metal connecting plate connects said first ground layer of said first dielectric substrate with said second ground layer of said second dielectric substrate through said at least three metal through holes.

2. The signal line conversion structure of an antenna array according to claim 1, wherein said second dielectric substrate is a soft substrate or a flexible substrate, and wherein said second dielectric substrate is bendable for reorientation of said antenna array.

3. The signal line conversion structure of an antenna array according to claim 1, wherein said circuit substrate is a circuit substrate of a power amplifier array.

4. The signal line conversion structure of an antenna array according to claim 1, wherein said antenna array is a high-power antenna array.

5. The signal line conversion structure of an antenna array according to claim 4, wherein said high-power antenna array is a high-frequency antenna of a 5th generation or more advanced wireless communication technology.

6. The signal line conversion structure of an antenna array according to claim 1, wherein said first dielectric substrate is a high-frequency circuit board.

7. The signal line conversion structure of an antenna array according to claim 1, wherein said second dielectric substrate is a high-frequency microwave radio-frequency circuit board.

8. The signal line conversion structure of an antenna array according to claim 1, wherein each said metal through hole has a diameter of 0.2 mm.

9. The signal line conversion structure of an antenna array according to claim 1, wherein said at least one signal line is a microstrip line.

10. The signal line conversion structure of an antenna array according to claim 1, wherein one terminal of said at least one signal line, which is extended to said second dielectric substrate, is aligned with a middle one of said at least three metal through holes.

* * * * *